US006450851B1

(12) United States Patent
Rehkemper et al.

(10) Patent No.: US 6,450,851 B1
(45) Date of Patent: Sep. 17, 2002

(54) BUBBLE MAKING TOY

(75) Inventors: Steven Rehkemper; Jeffrey Rehkemper, both of Chicago, IL (US)

(73) Assignee: Rehco, LLC

( * ) Notice: Subject to any disclaimer, the term of this patent is extended or adjusted under 35 U.S.C. 154(b) by 0 days.

(21) Appl. No.: 09/934,341

(22) Filed: Aug. 22, 2001

(51) Int. Cl.[7] ..... A63H 33/28
(52) U.S. Cl. ..... 446/15; 446/479
(58) Field of Search ..... 446/15–21, 481, 446/479; D21/401, 402

(56) References Cited

U.S. PATENT DOCUMENTS 3,120,717 A * 2/1964 Glass et al. ..... 446/397
3,808,730 A * 5/1974 Cooper et al. ..... 425/409
4,214,401 A * 7/1980 Teter
4,515,359 A * 5/1985 Mariol ..... 108/33
5,528,014 A * 6/1996 Goldberg et al. ..... 126/19 R

* cited by examiner

*Primary Examiner*—Jacob K. Ackun
*Assistant Examiner*—Bena B. Miller

(57) ABSTRACT

A bubble blowing toy in the shape of a barbeque unit. The kettle portion of the barbeque unit contains a grill and a power driven fan located below the grill. A bubble solution is poured on the grill and it forms a film thereon. When the fan is turned on bubbles are formed by the solution on the grill. Accessories having shape of foods normally grilled are also provided. These accessories also have openings over which a film is formed and arrays of bubbles will be formed having the outline of such accessories when the fan is turned on.

6 Claims, 1 Drawing Sheet

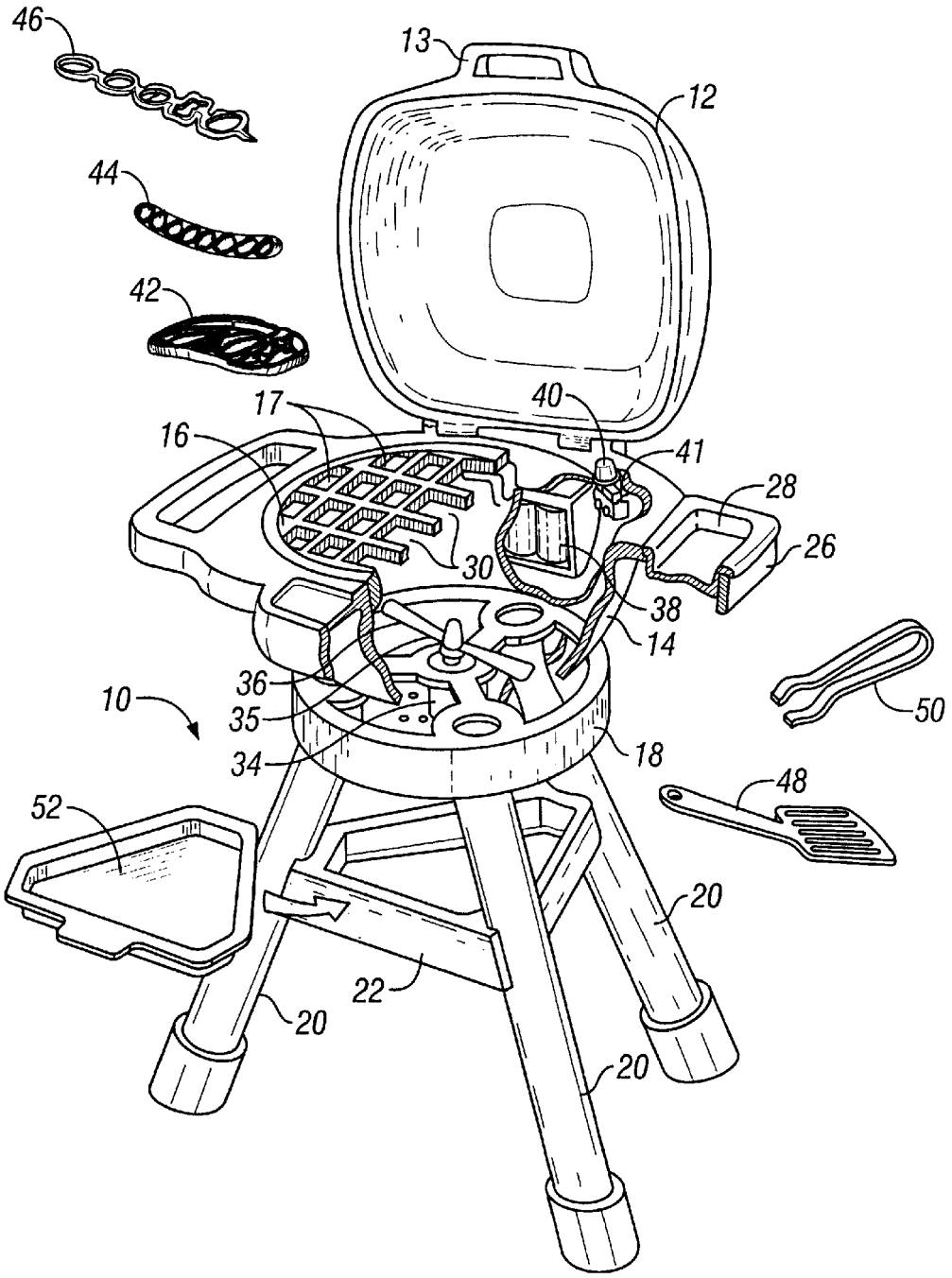
46
13
12
44
42
17
40
16
41
28
26
30
38
14
36
10
35
50
34
18
48
52
20
22
20
20

BUBBLE MAKING TOY

FIELD OF THE INVENTION

This invention relates generally to a bubble blowing toy that resembles a barbeque grill and can be operated to form an array of bubbles in the shape of various items that are typically barbequed such as a steak, hamburger or hotdog.

BACKGROUND OF THE INVENTION

Bubble blowing toys are well known and have been designed in various shapes and sizes all of which operate in substantially the same manner. They require a quantity of bubble blowing solution which for the most part is a simple soap and water combination. In addition they require a source of air under pressure that generates an air flow so that when the air under pressure engages the film of soap and water combination a rising bubble or series of bubbles are formed. Types of devices that can be used for generating an air flow includes fans and hand manipulated air pumps.

A variety of toy devices have been developed such as one described and illustrated in U.S. Pat. No. 6,200,184 in which the bubble maker toy comprises a bubble wand and an electric fan. The bubble wand includes a plurality of bubble rings assembled together by connecting arms. The electric fan is configured for concentrating on air flow adjacent to the center of the bubble wand which forces the bubble streams outward from the center of the bubble wand and away from each other.

Another example is found in the Coons U.S. Pat. No. 4,133,138 which sets forth a bubble forming and projecting device having a base upon which a generally spherical housing is supported. The housing receives a quantity of bubble blowing solution and supports an upwardly directed air blower. A cylindrical member having a plurality of fluid retaining apertures formed therein is rotated within the spherical housing to carry fluid to the upwardly directed blower to produce bubbles.

In the U.S. Pat. No. 5,643,035 issued to Freese et al there is set forth a bubble producing device using a rotating turbine wheel with pin members which utilizes a housing having an entry port and an exit port and a chamber defined therein in flow communication with both ports. A turbine wheel is provided to generate air flow and a bubble solution is supported within the chamber to be exposed to air flow and produces bubbles.

Melotti U.S. Pat. No. 4,367,608 sets forth a bubble emitting toy vehicle in which the toy vehicle supports a reservoir which receives a quantity of bubble blowing fluid. A pump is supported upon the vehicle to provide a source of air when depressed. A quantity of bubble blowing solution is introduced into the air stream to form bubbles.

U.S. Pat. No. 4,764,141 issued to D'Andrade sets forth a toy bubble blowing machine having a housing supporting a quantity of bubble solution together with an air blowing impeller. A plurality of bubble rings are supported on a common shaft by a corresponding plurality of radially extending arms. The plurality of rings are rotated to be immersed in the fluid and then moved into the path of the air flow.

While the foregoing prior art devices have been provided and enjoy a degree of commercial success there still remains a need in the art for ever improved interesting and amusing bubble blowing toys.

SUMMARY OF THE INVENTION

Accordingly, it is a general object of the present invention to provide an improved bubble blowing toy which can be readily operated and will permit a child to emulate a parent who is cooking steaks or a variety of other various things that one will find at a picnic or in a outdoor barbeque set-up. The bubble blowing device is in the shape of a conventional barbeque apparatus consisting of a kettle formed on a plurality of legs. The kettle has extending across its upper open portion a grill which can be closed by a lid that closes the upper portion of the kettle. The grill includes a plurality of openings that have inwardly extending fins. Thus when a bubble blowing liquid is poured over the grill openings a film of liquid will adhere to and form a surface which when acted on by air under pressure from beneath the grill will form the film into a series of bubbles that will float upwardly therefrom. Specifically, the grill has a fan motor with attached fan located in the bottom of the kettle portion. The fan motor is battery operated and is turned on off by an easily actuatable switch. Thus in its most simplest form if a bubble liquid is poured over the grill and its openings and adheres thereto and the fan is turned on a plurality of upwardly flowing bubbles are formed.

To make the toy barbeque more interesting to a child and more like what the father is doing toy accessories shaped in the form of a piece of steak, a hotdog, a shishkabob or the like are provided which have the desired outer shape and have finned openings in them that when placed on the grill and the bubble making liquid poured thereover a thin film is formed and then when the fan motor is subsequently turned on a cluster of bubbles in the shape of the accessory is formed. Thus a child wanting to emulate his parent can be effectively "broiling" a steak of hotdog on the grill in the same manner as his father. This provides a highly desirable toy which will keep the child occupied and the child will receive a great degree of pleasure making "dinner" with a parent.

The toy barbeque grill is provided with similar cooking tools as a real barbeque grill in that utensils are provided to handle the steak, hotdogs and so forth and trays are located along side the kettle into which the utensils can be placed.

In order to save the bubble solution that is not used a movable drip tray is provided beneath the bottom of the kettle.

Other features and advantages of the toy will be seen from the following description in which FIG. 1 shows an exploded perspective view of the toy bubble forming barbeque.

Referring to FIG. 1 there is illustrated a toy barbeque assembly 10 consisting of a lid 12 that includes a handle 13 for moving the lid relative to the kettle portion 14 of the barbeque. Located within the kettle portion 14 is the grill 16 having a plurality of finned openings 17 about which more will be discussed later. The kettle 14 is positioned on a base 18 that is supported by legs 20. There is provided leg supports 22 disposed intermediate the legs 20.

Referring back to the upper portion of the barbeque device it is noted that the lid 12 is hinged to the kettle 14 by hinge 24 thereby permitting the grill to be open and closed. Located adjacent the open end of the kettle 14 is a tray support 26 that holds a tray 28.

Looking inside the kettle 14 at the grill 16 there is seen that there are fins 17 that extend inwardly of each of the openings 30 whereby when a bubble solution is poured onto the grill it will tend to adhere to the fins and form a film over the grill openings.

In order to form the film solution into bubbles after the liquid has been poured over the grill there is provided a fan motor 34 located in the base 18 which fan motor 34 has a shaft 35 to which is attached the fan blade 36. The fan is powered by batteries 38 that are controlled by a button 40 that operates an on off switch 41.

Now that we have illustrated and described a bubble blowing barbeque unit we can see that the barbeque unit would be more complete if we were to place on the barbeque device accessories in the shape of steaks, hotdogs, hamburgers and so forth. Such accessories would be particularly attractive and fun if such accessories would form an array of bubbles having a shape similar to the accessories. To this end the accessories are provided with openings over which a bubble film is provided and that upon the actuation of the fan an array of bubbles in the outline of the items in question will flow upwardly from the grill when the fan is actuated. Any number of different elements can be used and we have illustrated three namely the steak bubble unit 42, a hotdog bubble unit 44 and a shishkabob bubble unit 46.

In order to handle the accessories relative to the grill a toy spatula 48 and toy tongs 50 are provided very much like a typical barbeque grill would be provided with the same sort of utensils. It remains to note that any of the film liquid that falls to the bottom is captured in a removable drip tray 52.

It is intended to cover by the following claims all modifications and embodiments that fall within the true spirit and scope of the invention.

We claim:

1. A bubble blowing toy barbeque comprising:

a plurality of legs;

a kettle supported by said legs, the kettle having an open upper end;

a grill disposed across the open upper end of said kettle, the grill having a plurality of openings, the plurality of openings having fins that extend inwardly for retaining a bubble solution when said bubble solution is pored over the grill;

a motor operated fan in said kettle and below said grill; and a switch operably connected to the motor operated fan for turning the fan off and on, wherein when the bubble solution is poured over said grill, a film is formed thereover and when the fan is activated, bubbles are formed.

2. A bubble blowing toy barbeque as set forth in claim 1 including a plurality of objects having different shapes such that said objects are shaped to define foods, the objects have openings therethrough for retaining a bubble solution such that when one of the objects is placed on the grill and a bubble solution is poured over said object, a film of bubble solution is retained by said openings in said object such that when the fan is actuated an array of bubbles having the shape of the object is formed.

3. A bubble forming toy as set forth in claim 2 further including utensils provided for handling the objects.

4. A bubble forming toy as set forth in claim 1 in which the kettle has a lid and side trays are provided for supporting the utensils.

5. A bubble forming toy set forth in claim 1 in which a removable drip tray is provided between and supported by said legs below said kettle.

6. A bubble blowing toy barbeque comprising:

legs;

a kettle supported by said legs and having an opened end;

a grill disposed across the opened end of said kettle, the grill having a plurality of openings with fins that extend inwardly for retaining a bubble solution;

a motor operated fan in said kettle below said grill;

a switch means for turning the fan off and on; and a plurality of objects outlined in the shape of foods each of said objects having a plurality of openings with fins that extend inwardly for retaining a bubble solution, wherein when a bubble solution and one of said objects placed on the grill, is poured over said openings in the grill and the object and when the fan is activated bubbles flow upwardly from said grill, and where the object are located arrays of bubbles are formed having an outline of its respective shape.

* * * * *